US005993647A

United States Patent [19]

Huang et al.

[11] Patent Number: 5,993,647

[45] Date of Patent: Nov. 30, 1999

[54] CIRCULATION SYSTEM OF SLURRY

[75] Inventors: Chao-Yuan Huang; Peng-Yih Peng; Juan-Yuan Wu, all of Hsinchu, Taiwan

[73] Assignee: United Microelectronics Corp., Taipei, Taiwan

[21] Appl. No.: 09/112,996

[22] Filed: Jul. 10, 1998

[30] Foreign Application Priority Data

May 2, 1998 [TW] Taiwan ..... 87106799

[51] Int. Cl.[6] ..... B01D 17/12; B34B 1/00

[52] U.S. Cl. ..... 210/87; 137/565; 210/137; 210/167; 210/196; 451/60; 451/446

[58] Field of Search ..... 134/902; 210/87, 210/137, 194, 196, 258, 167, 900, 418; 451/6, 60, 446; 137/563, 565

[56] References Cited

U.S. PATENT DOCUMENTS

| | | | |
|---|---|---|---|
| 4,917,123 | 4/1990 | McConnell et al. | 134/902 |
| 5,324,425 | 6/1994 | Ellison | 210/167 |
| 5,664,990 | 9/1997 | Adams et al. | 451/60 |
| 5,710,069 | 1/1998 | Farkas et al. | 451/6 |
| 5,791,970 | 8/1998 | Yueh | 451/60 |
| 5,895,315 | 4/1999 | Pinder | 451/60 |

*Primary Examiner*—Joseph W. Drodge
*Attorney, Agent, or Firm*—Thomas, Kayden, Horstemeyer & Risley

[57] ABSTRACT

A slurry filtration system for supplying a slurry to a polisher to perform a chemical mechanical polishing process. The system comprises a first three-way valve, to receive the slurry supplied from an external system; a slurry pump, to control the slurry flowing from the first three-way valve, and to maintain a circulating state of the slurry within the circulating system after the chemical mechanical polishing process comes to a stop; a slurry filter, to filter a plurality of large size particles in the slurry pumped from the slurry pump; a second three-way valve, to supply the slurry flowing from the filter to the polisher; and a transportation pipe, connecting between the first and the second three-way valves to transport the slurry from the second three-way valve back to the first three-way valve when the polishing process has stopped.

10 Claims, 2 Drawing Sheets

CIRCULATION SYSTEM OF SLURRY

CROSS-REFERENCE TO RELATED APPLICATION

This application claims the priority benefit of Taiwan application Ser. No. 87106799, filed May 2, 1998, the full disclosure of which is incorporated herein by reference.

BACKGROUND OF THE INVENTION

1. Field of the Invention

The invention relates in general to a filtration circulation system of a chemical mechanical polisher, and more particularly, to a circulation system which maintains a constant flow of slurry in a polisher to prevent the deposit of particles.

2. Description of the Related Art

Chemical mechanical polishing (CMP) is the only technique that provides a global planarization of devices for very large scaled integration (VLSI), or even ultra-large scaled integration (ULSI). In chemical mechanical polishing, a polishing apparatus similar to a grinder is adapted with an appropriate chemical agent to planarize uneven profiles of chips. A slurry is commonly used as a chemical agent in chemical mechanical polishing. The slurry comprises a colloidal silicon dioxide or a dispersoid of alumina mixed with the solution of potassium hydroxide (KOH) or ammonium hydroxide. The very highly abrasive particles in such a slurry and some added oxidant and organic solvent therein are used to facilitate the polishing process.

Therefore, the factors which determine the resultant planarization from chemical mechanical polishing include the components of slurry distribution and size of slurry particles, slurry supplying speed, and pH value of the slurry. In chemical mechanical polishing systems, a filter is installed for filtering slurry particles in a large size in order to reduce the scratch on the surface during polishing. However, while the polishing process stops or after a duration of operation, these large size particles deposit. In addition, while the polishing is in process, small size particles easily agglomerate into large size particles. The scratch on surfaces of chips during polishing is inevitable. Moreover, the deposit of large size particles blocks the filter and affects the slurry flow. Once the slurry flow is affected, scratches or damage to the chips become even more severe.

FIG. 1 shows a filtration system in a conventional chemical mechanical polisher. As shown in the figure, a slurry is controlled by a switch 10 to flow through a slurry pump 12. The slurry is then pumped by the slurry pump 12 to a slurry filter 14. After the particles of large size have been filtered by the filter 14, the flow of slurry is controlled by another switch 16 to flow to a polisher for performing a chemical mechanical polishing. While the polisher stops working, the switches 10 and 16 are shut, so that the slurry in the slurry filtration system 18 can not maintain a flowing and circulating state. The particles in the slurry therefore agglomerate into large particles. To avoid the deposit or agglomeration of particles, a deionized water (DI water) is used in the filtration system 18 to clean the residue slurry for polishing. Therefore, while performing chemical mechanical polishing, it is difficult to supply slurry into the filtration system 18 in a timely fashion. For example, the concentration of the abrasive particles is insufficient to performing polishing at the beginning of the process. A long duration is required to supply slurry with a sufficient concentration of small size particles. The stability and performance of chemical mechanical polishing processes are thus affected.

SUMMARY OF THE INVENTION

It is therefore an object of the invention to provide a slurry filtration system. While the chemical mechanical polishing process comes to a stop, the particles in a slurry do not agglomerate or deposit. The slurry is thus supplied fluently to maintain an effective chemical mechanical process.

To achieve these objects and advantages, and in accordance with the purpose of the invention, as embodied and broadly described herein, the invention is directed towards a slurry filtration system for supplying a slurry to a polisher to perform a chemical mechanical polishing process. The system comprises a first three-way valve, to receive the slurry supplied from an external system; a slurry pump, to control the slurry flowing from the first three-way valve, and to maintain a circulating state of the slurry within the circulating system after the chemical mechanical polishing process comes to a stop; a slurry filter, to filter a plurality of large size particles in the slurry pumped from the slurry pump; a second three-way valve, to supply the slurry flowing from the filter to the polisher; and a transportation pipe, connecting between the first and the second three-way valves to transport the slurry from the second three-way valve back to the first three-way valve.

It is to be understood that both the foregoing general description and the following detailed description are exemplary and explanatory only and are not restrictive of the invention, as claimed.

DESCRIPTION OF THE PREFERRED EMBODIMENTS

Figure 1:
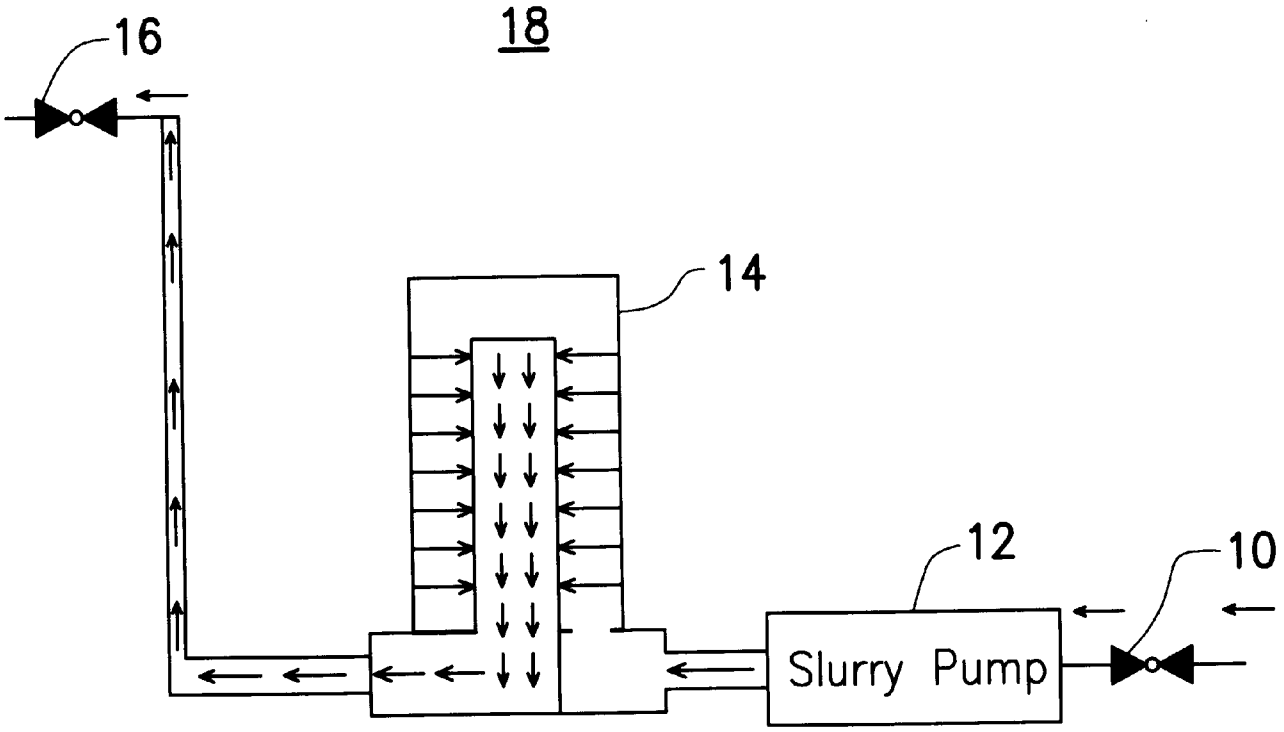
FIG. 1 (PRIOR ART)
FIG. 1 shows a slurry filtration system of a conventional chemical mechanical polisher.
Figure 2:
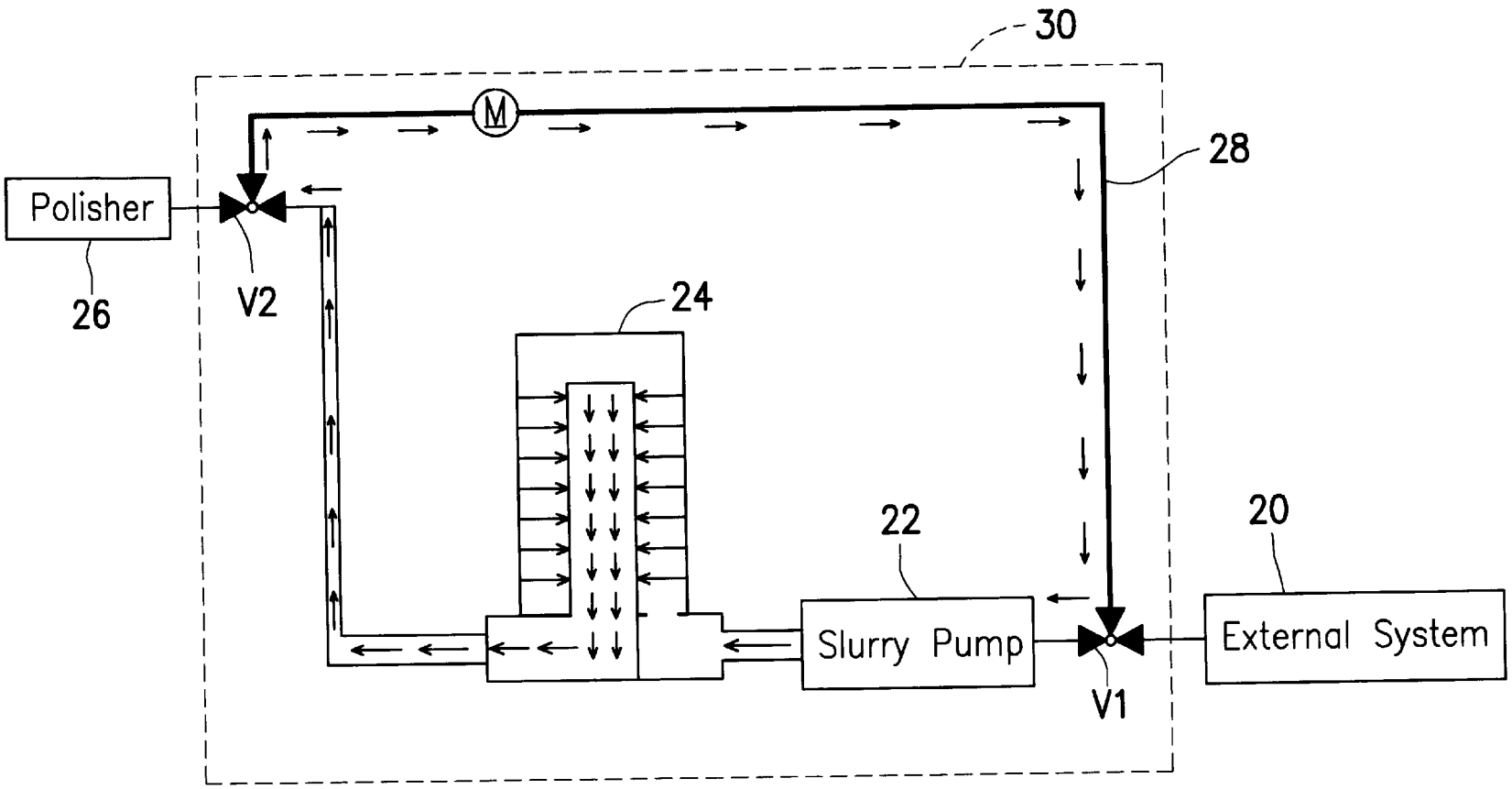
FIG. 2 shows a slurry filtration circulation system in a preferred embodiment according to the invention.

FIG. 2 shows a slurry filtration circulation system in a preferred embodiment according to the invention. As shown in the figure, while the system is performing chemical mechanical polishing, a slurry is supplied from an external system 20 to a three-way valve V1 in a circulation system 30. Through the three-way valve V1 which can be controlled by a software, the slurry flows to a slurry pump 22. The slurry is then pumped into a filter 24. After the particles of a large size in the slurry have been filtered by the filter 24, the slurry flows through a second three-way valve V2. Similarly to the first three-way valve V1, the second three-way valve can be controlled by a software. After the second three-way valve, the slurry flows into a polisher 26 for performing chemical mechanical polishing.

When the chemical mechanical polishing process comes to a stop, the first three-way valve V1 is automatically switched to avoid supplying additional slurry into the circulation system 30. The second three-way valve V2 is shut to stop supplying the slurry to the polisher 26. The slurry remaining in the circulation system 30 is still circulating by the polishing pump 22. That is, the slurry is pumped by the polishing pump 22 so as to flow back to the first three-way valve V1 through a transportation pipe 28. The slurry is thus circulating through the polishing pump 22, the polishing filter 24, the second three-way valve V1, the transportation pipe 28 and the first three-way valve V2 within the circulating system 30, even when the chemical mechanical polishing process stops. Since the slurry within the circulating system 30 is kept circulating, the problem of agglomerated particles or deposit of particles is avoided. The chemical mechanical polishing is performed without being degraded.

In addition, a flow meter M is installed on the transportation pipe 28 to monitor the operation status of the slurry filter 24. When the chemical mechanical polishing comes to a stop, the circulating status of slurry is detected by the flow meter M. In case that the slurry filter 24 is blocked by too many large size particles or a deposit of particles, the information is obtained from reading the flow meter M. A treatment of the slurry is required to prevent from damaging the chips to be polished.

One of the advantage of the invention is that the slurry is kept circulating within the circulation system when the polishing comes to a stop. Therefore, the agglomeration of particles and deposit of particles can be avoided, so that the slurry supply is not blocked.

Another advantage of the invention is that without the formation of agglomerated particles, the chips are protected from being scratched, or even damaged by the slurry during polishing.

The other advantage of the invention is that by installing a flowing meter on the transportation pipe, the slurry flow within the circulation system is being detected. In case that any problem of slurry supply occurs, a treatment of the slurry is given to prevent damaging the chip to be polished.

Other embodiment of the invention will appear to those skilled in the art from consideration of the specification and practice of the invention disclosed herein. It is intended that the specification and examples to be considered as exemplary only, with a true scope and spirit of the invention being indicated by the following claims.

What is claimed is:

1. A slurry dispensing system constructed and arranged for dispensing a chemical mechanical polishing slurry to a chip, the system comprising:

a first three-way valve, to receive the slurry supplied from an external source;

a slurry pump, to drive the slurry from the first three-way valve for dispensing the slurry to the chip, and to maintain a circulating state of the slurry when the system has ceased dispensing the slurry to the chip;

a slurry filter, to filter a plurality of large size particles in the slurry;

a second three-way valve, used for dispensing the slurry to the chip from the slurry filter; and a transportation pipe, connecting between the first and the second three-way valves, wherein the slurry remains circulating from the second three-way valve to the first three-way valve through the transportation pipe while the system has ceased dispensing the slurry to the chip.

2. The system according to claim 1, wherein the circulation system further comprises a slurry flow rate meter installed on the transportation pipe, so as to detect a flowing status of the slurry.

3. The system according to claim 1, wherein the slurry is dispensed to the chip from the second three-way valve through chemical mechanical polishing (CMP) equipment, which is used to polish the chip.

4. The system according to claim 1, wherein when the system has ceased dispensing the slurry to the chip, the first three-way valve is not operable for receiving slurry from the external source.

5. A dispensing system constructed and arranged for dispensing a chemical mechanical polishing slurry to a chip in use for a treatment on the chip, the system comprising:

a first three-way valve, to receive the slurry from an external source;

a second three-way valve, used for dispensing the slurry to the chip;

a slurry pump installed between the first three-way valve and the second three-way valve, used to drive the slurry from the first three-way valve to the second three-way valve;

a slurry filter installed between the first three-way valve and the second three-way valve and coupled to the slurry pump, so as to filter a plurality of large size particles in the slurry; and a return circulation route from the first three-way valve and the second three-way valve, wherein as the system has ceased dispensing the slurry to the chip, the slurry can be driven by the pump from the second three-way valve back to the first three-way valve, so that the remains circulating.

6. The system according to claim 5, wherein the slurry comprises a slurry that is used for polishing the chip.

7. The system according to claim 6, wherein the slurry is dispensed from the second three-way valve to the chip through chemical mechanical polishing (CMP) equipment, which is used to polish the chip.

8. The system according to claim 5, wherein the system further comprises equipment installed between the chip and the second three-way valve for performing the treatment on the chip.

9. The system according to claim 5, wherein the system further comprises a slurry flow rate meter installed on the return circulation route, so as to monitor a flowing status of the slurry.

10. The system according to claim 5, wherein when the system has ceased dispensing the slurry to the chip, the first three-way valve is not operable for receiving the slurry from the external source.

* * * * *